US008128726B2

(12) United States Patent
Heggset et al.

(10) Patent No.: US 8,128,726 B2
(45) Date of Patent: Mar. 6, 2012

(54) METHOD AND DEVICE FOR ADMIXTURE OF POWDER IN A LIQUID

(75) Inventors: Bjarne Anders Heggset, Kristiansund N (NO); Per Gunnar Strand, Sandefjord (NO); Jo Henrik Vaagland, Kristiansund N (NO)

(73) Assignee: Heggset Teknologi AS, Kristiansund (NO)

( * ) Notice: Subject to any disclaimer, the term of this patent is extended or adjusted under 35 U.S.C. 154(b) by 106 days.

(21) Appl. No.: 12/307,326

(22) PCT Filed: Jun. 22, 2007 (Under 37 CFR 1.47)

(86) PCT No.: PCT/NO2007/000225

§ 371 (c)(1), (2), (4) Date: Nov. 4, 2009

(87) PCT Pub. No.: WO2008/010721

PCT Pub. Date: Jan. 24, 2008

(65) Prior Publication Data

US 2010/0050815 A1 Mar. 4, 2010

(30) Foreign Application Priority Data

Jul. 4, 2006 (NO) ..... 20063101

(51) Int. Cl.
*C22B 9/05* (2006.01)

(52) U.S. Cl. ..... 75/414; 75/680; 164/63; 164/65; 222/595; 266/208; 266/267

(58) Field of Classification Search ..... 75/414, 75/680–685, 10.64; 164/63, 65; 222/595; 266/208, 267

See application file for complete search history.

(56) References Cited

U.S. PATENT DOCUMENTS

| | | | | |
|---|---|---|---|---|
| 3,338,560 | A | 8/1967 | Katzer et al. | |
| 3,819,157 | A | 6/1974 | Markfelt | |
| 3,881,656 | A | 5/1975 | Markfelt et al. | |
| 5,413,315 | A | 5/1995 | Venas et al. | |
| 5,531,425 | A * | 7/1996 | Skibo et al. | 266/208 |
| 6,360,809 | B1 * | 3/2002 | Cornie et al. | 164/65 |
| 6,375,712 | B1 * | 4/2002 | Forberg et al. | 75/680 |

FOREIGN PATENT DOCUMENTS

| | | |
|---|---|---|
| NO | 319478-81 | 8/2005 |

* cited by examiner

*Primary Examiner* — George Wyszomierski
*Assistant Examiner* — Tima M McGuthry Banks
(74) *Attorney, Agent, or Firm* — Birch, Stewart, Kolasch & Birch, LLP

(57) ABSTRACT

A method and a device for admixture of powder in a liquid, whereby the method comprises that the liquid in a supply (14), influenced by underpressure in a crucible (12) to which the liquid is to be transferred, flows through a drain tube (6) out of the supply (14), the powder is dosed from a powder receptacle (1) and is driven by a gas, and the mixture of powder and gas is added to the liquid in the drain tube (6) and mixed therewith, whereupon the mixture flows into the crucible (12). The device comprises a supply (14) from which the liquid may flow and a receptacle (1) with powder, whereby a drain tube (6) connects the supply (14) with a receiving receptacle (12) which can be held at an inner underpressure. A device (4) for supply of a driving gas for the powder is connected to a mixing chamber (3) at an outlet from the powder receptacle (1), while the mixing chamber (3) is connected to the drain tube (6) for supply of powder to the liquid flowing in the drain tube.

19 Claims, 1 Drawing Sheet

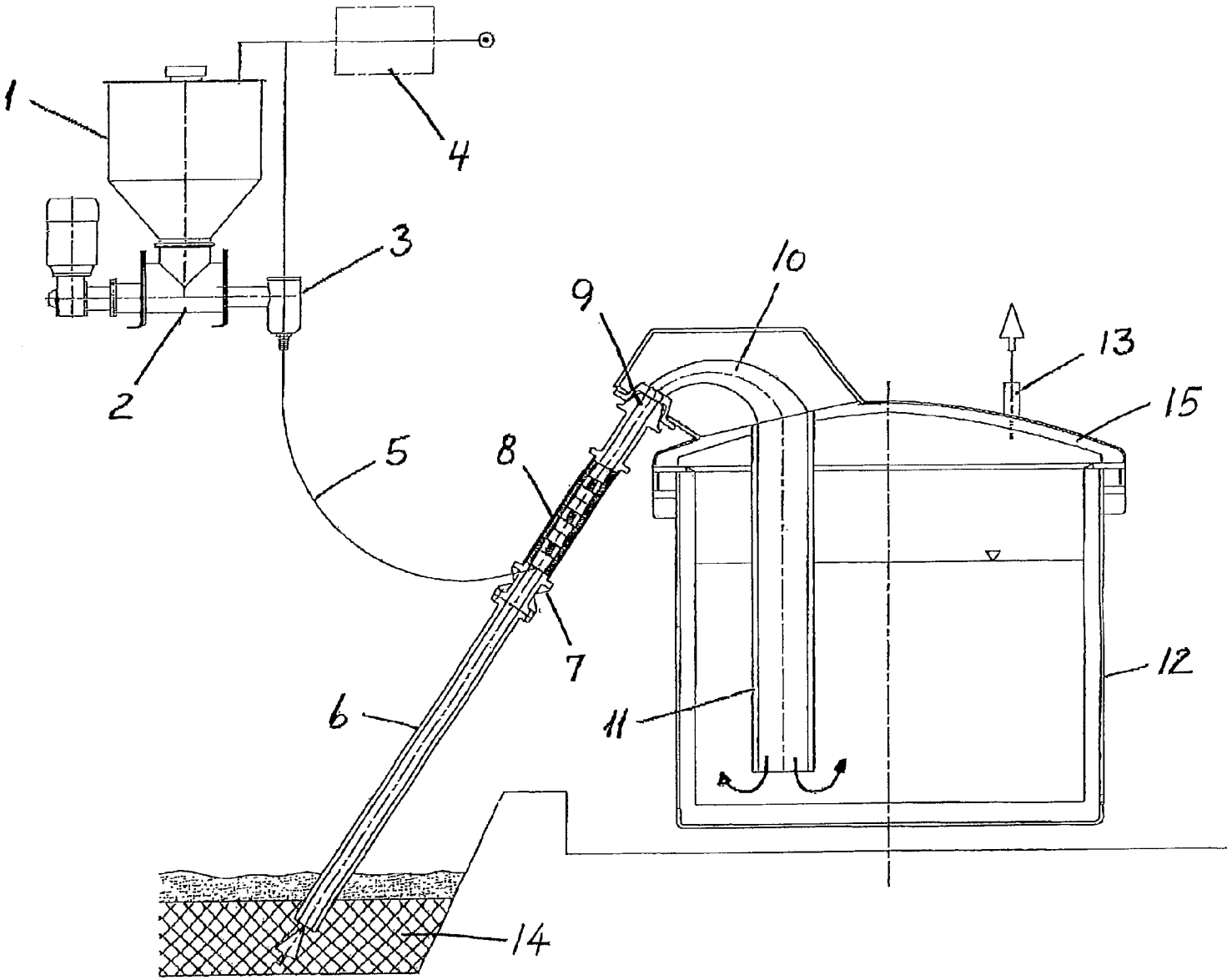
1
2
3
4
5
6
7
8
9
10
11
12
13
14
15

METHOD AND DEVICE FOR ADMIXTURE OF POWDER IN A LIQUID

CROSS-REFERENCE TO RELATED APPLICATIONS

This application is a National Stage of PCT/NO2007/000225 filed on Jun. 22, 2007, which claims priority under 35 U.S.C. §119(a) on Patent Application No. 20063101 filed in Norway on Jul. 4, 2006.

BACKGROUND OF THE INVENTION

1. Field of the Invention

The present invention relates to a method and a device for admixture of powder in a liquid. Examples are adding of aluminium fluoride in aluminium in order to remove sodium and adding of alloy elements in a molten alloy.

2. Background of the Invention

Removal of sodium from liquid aluminium may for instance take place in the process line between an electrolytic furnace and a holding furnace/casting furnace in a foundry. Stirring of aluminium fluoride powder ($AlF_3$) is carried out by means of a rotor or a propeller, and the purpose of the method is to distribute the powder finely in the melt. The process is time consuming (10-15 min.) and also requires relatively large investments in equipment. The temperature in the melt is also often an economic factor, and stirring in of contaminants from the surface of the melt may be a problem. This applies correspondingly to addition of alloy elements.

SUMMARY OF THE INVENTION

By the present invention has been provided a method and a device which are characterized by the features appearing from the succeeding claims.

According to an embodiment of the present invention the powder is added in connection with transfer of liquid metal either from an electrolytic furnace to a transportation crucible or from a transportation crucible to a holding furnace/a casting furnace. While maintaining underpressure in the receptacle to which the metal is transferred, the liquid metal is sucked out of a supply and through a drain tube, and the powder is added to the metal in the drain tube, the metal with the added powder flows into the receptacle through a bent tube. Preferentially, a receiving tube is installed in the receptacle, in order to direct the metal and the powder down to the vicinity of the bottom of the receptacle. There, the metal and the powder flows out of the receiving tube and causes stirring in the metal in the receptacle.

BRIEF DESCRIPTION OF THE DRAWINGS

The present invention will become more fully understood from the detailed description given hereinbelow and the accompanying drawing which are given by way of illustration only, and thus are not limitative of the present invention, and wherein:

FIG. 1 is a device for admixture of powder in a liquid according to an embodiment of the present invention.

DETAILED DESCRIPTION OF THE PREFERRED EMBODIMENTS

The present invention will now be described in detail with reference to the accompanying drawing. It should be noted that the drawing should be viewed in the direction of orientation of the reference numerals.

The underpressure has shown to have a favourable influence on the ability of the aluminium fluoride powder to remove sodium from liquid aluminium.

In an embodiment shown diagrammatically on the accompanying drawing, for admixture of powder to molten metal while transferring it to for instance a receptacle 12 in the form of for instance a holding furnace or a crucible, from a supply, for instance in the form of an electrolytic cell 14, the device according to the invention consists of the following equipment:

A powder receptacle 1, consisting of

- a dosage unit 2 for dosing the amount of powder flowing out of the powder receptacle 1,
- a mixing chamber 3 for powder and conveying gas for the powder,
- an adjustment unit 4 which adjusts the pressure and the amount of powder being added.

A conveying line 5 for powder and gas from the mixing chamber 3.

A drain tube 6 for molten metal, comprising an injector unit 7 on the drain tube 6, a mixing zone 8 in the drain tube 6.

A crucible cover 15 on the crucible 12.

A bend 10 between the drain tube 6 and the crucible cover 15.

A connector 13 for suction, in order to maintain underpressure in the crucible 12.

Optionally, a connector piece 9 between the drain tube 6 and the bend 10 on the crucible 12.

Optionally, a receiving tube 11 in the crucible 12, connected to the bend 10.

An example of the use of the device according to the invention is described.

Powder, for instance aluminium fluoride ($AlF_3$), is filled into the powder receptacle 1. The powder is dosed into a mixing chamber by means of a feeder, and a conveying gas, such as argon, nitrogen or air, is supplied through the adjustment unit 4 and forces the powder through the conveying line 5 and into the drain tube 6 through the injector unit 7, where the powder is injected into the liquid metal which flows upwardly in the drain tube 6. The injection may take place concurrently with, counter-currently of or crosswisely of the flow of the metal. The drain tube 6 may contain one or more mixing zones 8, for instance having stationary elements which cause turbulence and thereby thorough mixing of molten metal and powder. Alternatively, a magnetic field around the drain tube may be used.

The crucible 12 may contain a receiving tube 11 which directs the mixture of molten metal and powder downwardly towards the bottom of the crucible 12. Because the mixture flows out of the receiving tube 11 and into the liquid metal already present in the crucible 12, a stirring and currents occur in the molten metal, which metallurgically is favourable with respect to the effect of the powder.

Moreover, gas may be supplied from the bottom of the crucible 12. Alternatively, the bend 10 in the crucible cover may be sealed when no molten metal flows through the drain tube 6, and gas may be supplied through the connector piece 9, towards the bottom of the crucible 12 through the receiving tube 11. The gas will cause bubbling in the liquid metal and thereby a stirring which increases the effect of the powder and improves the mixing process. This supply of gas may for instance be carried out during transport of the crucible 12 from an electrolytic cell to a casting furnace.

The most important advantages of the method and the device according to the invention are:

They do not lead to longer cycle times than ordinary draining and transfer.

Low investment costs compared with known methods and devices.

Little space demanding, may easily be installed in existing plants.

May be installed on crucible or drain wagon/crucible.

A possible effluent of smoke and dust may be taken care of by an existing suction system on a furnace.

A minimum of temperature loss.

An optimal utilization of the powder.

A small consumption of gas during injection.

It will be appreciated that liquid aluminium and aluminium fluoride as powder are only mentioned as examples which to not imply any limitation of the scope of the invention.

The invention claimed is:

1. A method for admixture of powder in a liquid, comprising:

flowing the liquid in a supply, influenced by underpressure in a crucible to which the liquid is to be transferred, out of the supply and upwardly through a drain tube, dosing the powder from a powder receptacle and driving the powder by a gas, and adding the mixture of the powder and the gas to the liquid in the drain tube and mixing the mixture of the powder and the gas with the liquid in the drain tube, whereupon the mixture flows into the crucible.

2. The method according to claim 1, wherein the powder is supplied to the drain tube in a mixing zone.

3. The method according to claim 2, carried out with liquid in the form of molten aluminium and powder in the form of aluminium fluoride.

4. The method according to claim 2, carried out with liquid in the form of an alloy and powder in the form of an alloy constituent.

5. The method according to claim 1, wherein the mixture is supplied to the crucible through a cover on the crucible and downwardly through a receiving tube inside the crucible, and thereupon out through a lower, open end of the receiving tube.

6. The method according to claim 5, carried out with liquid in the form of molten aluminium and powder in the form of aluminium fluoride.

7. The method according to claim 5, carried out with liquid in the form of an alloy and powder in the form of an alloy constituent.

8. The method according to claim 1, carried out with liquid in the form of molten aluminium and powder in the form of aluminium fluoride.

9. The method according to claim 1, carried out with liquid in the form of an alloy and powder in the form of an alloy constituent.

10. A device for admixture of powder in a liquid, comprising a supply from which the liquid flows and a receptacle with powder, wherein a drain tube connects the supply with a higher situated receiving receptacle which is held at an inner underpressure, whereby a device for supply of a driving gas for the powder is connected to a mixing chamber at an outlet from the powder receptacle, while the mixing chamber is connected to the drain tube for supply of powder to the liquid flowing in the drain tube.

11. The device according to claim 10, wherein the drain tube contains a mixing zone.

12. The device according to claim 11, wherein an injecting unit for powder is installed on the drain tube.

13. The device according to claim 11, comprising a dosage unit for dosing the amount of powder which flows out of the powder receptacle.

14. The device according to claim 11, comprising an adjustment unit which adjusts the pressure and the amount of gas being supplied.

15. The device according to claim 10, wherein an injecting unit for powder is installed on the drain tube.

16. The device according to claim 15, comprising a dosage unit for dosing the amount of powder which flows out of the powder receptacle.

17. The device according to claim 15, comprising an adjustment unit which adjusts the pressure and the amount of gas being supplied.

18. The device according to claim 10, comprising a dosage unit for dosing the amount of powder which flows out of the powder receptacle.

19. The device according to claim 10, comprising an adjustment unit which adjusts the pressure and the amount of gas being supplied.

* * * * *